US010349691B2

(12) United States Patent
Kishihara

(10) Patent No.: US 10,349,691 B2
(45) Date of Patent: Jul. 16, 2019

(54) GLOVE

(71) Applicant: SHOWA GLOVE CO., Hyogo (JP)

(72) Inventor: Hidetoshi Kishihara, Hyogo (JP)

(73) Assignee: Showa Glove Co., Hyogo (JP)

( * ) Notice: Subject to any disclaimer, the term of this patent is extended or adjusted under 35 U.S.C. 154(b) by 71 days.

(21) Appl. No.: 14/892,440

(22) PCT Filed: May 29, 2014

(86) PCT No.: PCT/JP2014/064338

§ 371 (c)(1),
(2) Date: Nov. 19, 2015

(87) PCT Pub. No.: WO2015/008545

PCT Pub. Date: Jan. 22, 2015

(65) Prior Publication Data

US 2016/0192721 A1 Jul. 7, 2016

(30) Foreign Application Priority Data

Jul. 19, 2013 (JP) ..... 2013-151031

(51) Int. Cl.
*A41D 19/00* (2006.01)
*A41D 19/015* (2006.01)

(52) U.S. Cl.
CPC . *A41D 19/01547* (2013.01); *A41D 19/01558* (2013.01); *A41D 2500/10* (2013.01)

(58) Field of Classification Search
CPC ..... A41D 19/01547; A41D 19/01557; A41D 2500/10
USPC ..... 2/159
See application file for complete search history.

(56) References Cited

U.S. PATENT DOCUMENTS 5,070,540 A * 12/1991 Bettcher ..... A41D 19/0058 156/165
8,855,454 B2 * 10/2014 Quinn ..... G02B 6/4413 385/104
2005/0069712 A1 * 3/2005 Strait ..... B29C 70/025 428/411.1
2010/0050319 A1 * 3/2010 Fujihana ..... A41D 19/0065 2/161.1

(Continued)

FOREIGN PATENT DOCUMENTS

EP 2468120 A1 6/2012
JP 2001-303374 A 10/2001

(Continued)

*Primary Examiner* — Timothy K Trieu
(74) *Attorney, Agent, or Firm* — Norris McLaughlin, P.A.

(57) ABSTRACT

A glove includes: a glove body made of fibers, the glove body being for covering a hand of a wearer; and a coating layer made of a resin or rubber, the coating layer being overlaid at least on a palm region of the outer surface of the glove body, in which a loop yarn is used as a knitting yarn of the glove body, and irregularities arising from the loop yarn are provided on the surface of the coating layer. The ten-point mean roughness (Rz) of the surface of the coating layer is preferably no less than 300 μm and no greater than 1,200 μm. The average outer diameter of loops of the loop yarn is preferably no less than 1 mm and no greater than 6 mm. The average distance between loops of the loop yarn is preferably no less than 1 mm and no greater than 10 mm.

2 Claims, 3 Drawing Sheets

(56) References Cited

U.S. PATENT DOCUMENTS

| | | | | |
|---|---|---|---|---|
| 2014/0283559 | A1* | 9/2014 | Andrews | A41D 19/01505<br>66/174 |
| 2014/0374018 | A1* | 12/2014 | Creaser | C08J 5/04<br>156/286 |

FOREIGN PATENT DOCUMENTS

| | | |
|---|---|---|
| JP | 2003-268611 | 9/2003 |
| JP | 2010-203012 | 9/2010 |
| JP | 2013-060683 | 4/2013 |
| JP | 2013-067879 A | 4/2013 |
| WO | WO-2011/021494 | 2/2011 |

* cited by examiner

GLOVE

TECHNICAL FIELD

The present invention relates to a glove.

BACKGROUND OF THE INVENTION

Gloves are used by workers who wear them in packing works, carrying works and the like at factories, etc., for example. As the gloves of this kind, gloves including a glove body made of fibers, and a coating layer made of a resin or rubber overlaid thereon for imparting an anti-slipping effect are publicly known.

Some conventional coating layers are made from rubber, etc., into which anti-slipping particles are incorporated through kneading; however, the surface of the conventional coating layers has a ten-point mean roughness (Rz) of 40 μm to 90 μm, indicating comparatively small irregularities. Moreover, the conventional coating layers may be hardly deformed in accordance with an object to be gripped and thus may have inferior followability, leading to a failure to achieve a sufficient anti-slipping effect. Furthermore, the conventional anti-slipping coating layers have a disadvantage that a part of the coating layer is likely to be detached together with the anti-slipping particles, leading to the deterioration of the anti-slipping effect.

To address these advantages, a glove having a glove body made of fibers and a coating layer made of a resin or rubber has been proposed, which is produced by: knitting the glove body by means of a pile knitting machine; turning the glove body inside out such that a pile fabric faces outside; and overlaying the coating layer on the pile fabric (Japanese Unexamined Patent Application, Publication No. 2003-268611). In this glove, although the surface of the glove has a ten-point mean roughness (Rz) of 150 μm to 230 μm, it is not yet considered that the glove achieves a sufficient anti-slipping effect, and a glove exhibiting a more superior anti-slipping effect has been demanded. In addition, when the pile fabric faces outside, the glove may exhibit inferior bending flexibility and be rigid due to a short average distance between loops on the outer surface and the presence of a large number of loops. Furthermore, there is a disadvantage that an inferior heat-retaining property is provided due to the absence of the loop on the inner surface which is to be brought into contact with a hand skin.

PATENT DOCUMENTS

Patent Document 1: Japanese Unexamined Patent Application, Publication No. 2003-268611

SUMMARY OF THE INVENTION

The present invention was made in view of the foregoing circumstances, and it is an object of the present invention to provide a glove that exhibits a superior anti-slipping effect, and achieves both superior bending flexibility and a superior heat-retaining property.

According to an aspect of the invention made for solving the aforementioned problems, a glove includes: a glove body made of fibers, the glove body being for covering a hand of a wearer; and a coating layer made of a resin or rubber, the coating layer being overlaid at least on a palm region of the outer surface of the glove body, in which a loop yarn is used as a knitting yarn of the glove body, and irregularities arising from the loop yarn are provided on the surface of the coating layer.

According to the glove, the loop yarn is used as the knitting yarn of the glove body. Since the loop yarn has an irregularly projecting float yarn, and this projecting float yarn provides adequate irregularities on the surface of the coating layer, the glove exhibits a superior anti-slipping effect. In addition, the float yarn of the loop yarn is secured to a core yarn by means of a presser yarn, and therefore is less likely to fall out. Therefore, the glove is less likely to cause the deterioration of the anti-slipping effect during the use thereof.

Moreover, according to the glove, since the loop yarn is used as the knitting yarn of the glove body, the float yarn projects from both sides, i.e., the inner surface and the outer surface, of glove body, a greater volume of an air layer can be involved, as compared with gloves having on one side a loop pile fabric produced through knitting by means of a pile knitting machine. Accordingly, a heat-retaining property either equaling or surpassing that of the glove employing the fabric obtained through knitting by means of the pile knitting machine can be exhibited at smaller total fineness. Therefore, the glove exhibits a superior heat-retaining property while achieving superior bending flexibility.

The average outer diameter of loops of the loop yarn is preferably no less than 1 mm and no greater than 6 mm. When the average outer diameter of loops falls within the above range, adequate irregularities may be provided on the surface of the coating layer, leading to a more superior anti-slipping effect.

The average distance between loops of the loop yarn is preferably no less than 1 mm and no greater than 10 mm. When the average distance between loops falls within the above range, a more superior anti-slipping effect and heat-retaining property may be exhibited.

The total fineness of the loop yarn is preferably no less than 100 dtex and no greater than 1,000 dtex. When the total fineness falls within the above range, the glove may achieve both more superior bending flexibility and a more superior heat-retaining property.

According to the glove, it is preferred that the inner surface of the glove body is not impregnated with the coating layer. When the inner surface of the glove body is not impregnated with the coating layer, the texture of the inner surface of the glove body may be maintained, and a feel of the glove during the use thereof may be improved.

According to the glove, at least a loop portion of the loop yarn projecting from the outer surface of the glove body is preferably impregnated with the coating layer. When at least the loop portion is impregnated with the coating layer, the glove can exhibit a superior anti-slipping effect while maintaining the heat-retaining property and the bending flexibility.

The ten-point mean roughness (Rz) of the surface of the coating layer is preferably no less than 300 μm and no greater than 1,200 μm. When the ten-point mean roughness (Rz) falls within the above range, the glove can ensure a more superior anti-slipping effect.

A B value that represents the bending flexibility of the glove as determined by a pure bending test is preferably no greater than 0.85 $gf \cdot cm^2/cm$. When the B value is no greater than the above upper limit, the glove may exhibit more superior flexibility and result in higher work efficiency.

The press bending load at a displacement of 1 mm from the lateral face of the protruding part arising from the loop yarn of the glove is preferably no greater than 0.45 N. When the press bending load is no greater than the above upper limit, the glove achieves more superior followability.

The moisture permeability of the coating layer of the glove after 500 abrasion cycles as determined using a tester, Nu-Martindale, defined by EN ISO 12947-1, in accordance with the European Standard EN 388; 2003 is preferably no less than 400 $g/m^2 \cdot 24$ h. When the moisture permeability is no less than the above lower limit, an unpleasant feeling due to retention of excessive moisture during the wearing of the glove may be reduced, and accordingly the glove can be worn comfortably over a long time period.

The loop yarn as referred to herein means a fancy yarn having a loop. The ten-point mean roughness (Rz) as referred to means a ten-point mean roughness defined by JIS B 0031 (1994). The average outer diameter of loops as referred to means an average of the diameter of a perfect circle having an area equal to the area surrounded by the center line of the float yarn and the center line of the core yarn in the loop portion, and when the loop is twisted, the average outer diameter of loops is determined for the loop obtained after untwisting. It is to be noted that the area can be determined, for example, by using an optical microscope (VHX-900) manufactured by Keyence Corporation. The average distance between loops as referred to means an average of the shortest distance between a point at which a first loop and the core yarn intersect and a point at which a second loop adjacent to the first loop and the core yarn intersect. The total fineness as referred to means the sum of the fineness of all yarns used. The bending flexibility (B value) as referred to means a flexural rigidity with respect to a width of 1 cm of the fabric, and is an indicative of an average inclination of a flexural moment in the range of the curvature of 0.5 $cm^1$ to 1.5 $cm^{-1}$. The press bending load at a displacement of 1 mm as referred to means a numerical value obtained by determining a load required to bend a protruding part by pressing from a lateral face and attain a displacement of 1 mm.

EFFECTS OF THE INVENTION

As explained in the foregoing, according to the glove of the aspect of the present invention, the glove body is produced using a loop yarn, and irregularities arising from the loop yarn are provided on the surface of the coating layer. Thus, the glove exhibits a superior anti-slipping effect, and achieves both superior bending flexibility and a superior heat-retaining property.

DESCRIPTION OF THE PREFERRED EMBODIMENTS

Hereinafter, embodiments of the present invention will be explained in detail with reference to the drawings.

Figure 1:
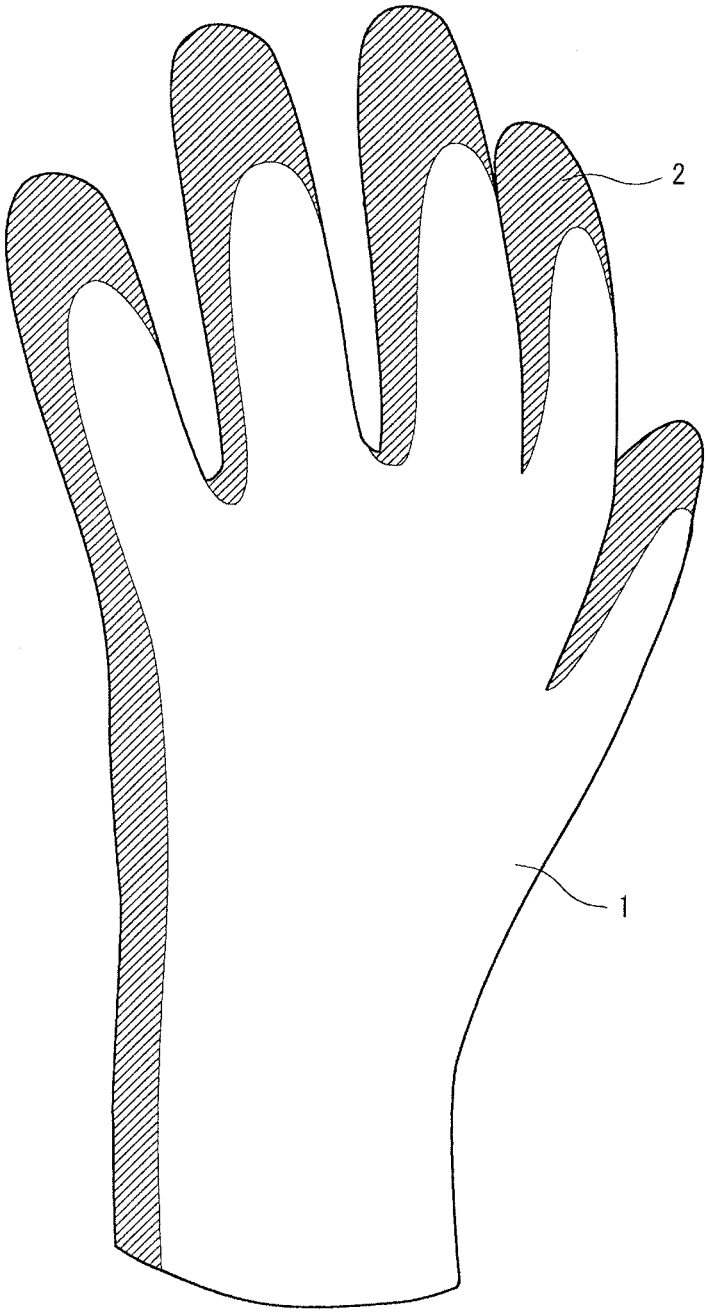
FIG. 1 shows a schematic view illustrating a glove according to an embodiment of the present invention when viewed from the side corresponding to the back side of the hand.
Figure 2:
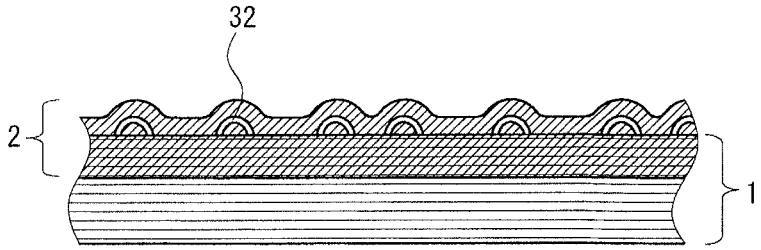
FIG. 2 shows a partial cross sectional view of the glove shown in FIG. 1.

The glove shown in FIG. 1 and FIG. 2 includes: a glove body 1 made of fibers, the glove body 1 being knitted using a loop yarn; and a coating layer 2 made of a resin or rubber, the coating layer 2 being overlaid on a palm (including fingers) region and the lateral regions thereof, and fingertip regions on the outer surface of the glove body 1.

Glove Body

Figure 3:
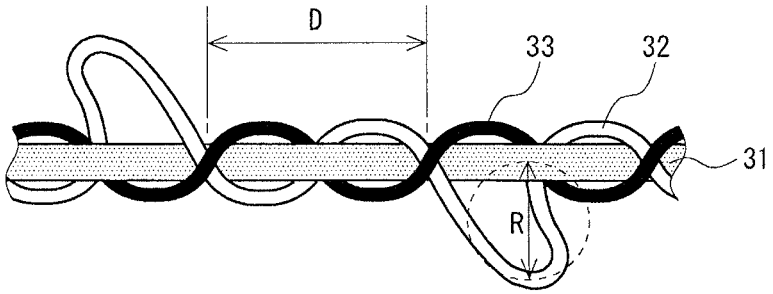
FIG. 3 shows a schematic view illustrating the structure of a loop yarn which may be used in the glove according to the present invention.

The loop yarn which may be used in the glove body 1 is explained with reference to FIG. 3. The loop yarn is composed of three types of yarns, i.e., a core yarn 31, a float yarn 32 and a presser yarn 33. The loop yarn has a configuration in which the float yarn 32 is arranged around the core yarn 31 so as to form a loop, and the presser yarn 33 is twisted therearound in an opposite direction, thereby preventing the collapse of the loop. The loop yarn may also have a horn-like shape by further twisting the loop.

As a fiber material of the loop yarn, a synthetic fiber such as acrylic, polyester, polyamide (trade name: nylon), reinforced polyethylene, aramid, polyurethane and polypropylene; a natural fiber such as cotton, wool, hemp and silk; or a regenerated fiber such as rayon and Cupro, may be used. These fiber materials may be used alone, or may be used in combination or in the form of a composite yarn. Further, it is preferred to use different fiber materials having an appropriate property for each of the core yarn 31, the float yarn 32, and the presser yarn 33. The core yarn 31 is required to fit the hand, and preferably has streatchability. Moreover, the core yarn 31 is preferably cut resistant. A yarn having streatchability is exemplified by Spandex, and the cut resistant yarn is exemplified by high-performance polyethylene (HPPE). The float yarn 32 is required to maintain the loop without being collapsed, and the yarn is preferably resilient. Such a yarn is exemplified by a spun yarn and uncrimped yarn, and for example, an acrylic fiber, a polyester fiber, a polyamide fiber, and the like are suitable. The presser yarn 33 is required to be thin, strong, and resistant to break. A polyester fiber, a polyamide fiber, and the like are suitable as such a yarn.

One of the characteristic features of the loop yarn is that a great average distance between loops can be attained. Accordingly, the number of the loops can be reduced, leading to favorable bending flexibility. In addition, since the float yarn 32 projects from both sides, i.e., the inner surface and the outer surface, of the glove body 1, a greater volume of an air layer can be involved, as compared with gloves having on one side a loop pile fabric produced through knitting by means of a pile knitting machine. Accordingly, a heat-retaining property either equaling or surpassing that of the glove employing the fabric obtained through knitting by means of the pile knitting machine can be exhibited at smaller total fineness. Thus, when the loop yarn is used, both the superior heat-retaining property and the superior bending flexibility can be achieved, unlike the glove employing the fabric obtained through knitting by means of the pile knitting machine.

The lower limit of the total fineness of the loop yarn is preferably 100 dtex, and more preferably 200 dtex. When the total fineness is less than the lower limit, the heat-retaining property may be impaired. On the other hand, the upper limit of the total fineness is preferably 1,000 dtex, and more preferably 900 dtex. When the total fineness is greater than the upper limit, the bending flexibility may be impaired.

The lower limit of the average outer diameter of loops of the float yarn 32 is preferably 1 mm, and more preferably 2 mm. When the average outer diameter of loops is less than the lower limit, irregularities having a sufficient height may not be provided on the surface of the coating layer 2 in overlaying the coating layer 2, and consequently an insufficient anti-slipping effect may be exhibited. On the other hand, the upper limit of the average outer diameter of loops is preferably 6 mm, and more preferably 4 mm. When the average outer diameter of loops is greater than the upper limit, unfavorable knitting of the glove may easily occur.

The lower limit of the average distance between loops of the float yarn 32 is preferably 1 mm, and more preferably 2 mm. When the average distance between loops is less than the lower limit, the loops would be too closely positioned on average for providing a sufficient recessed part on the surface of the coating layer 2 in overlaying the coating layer 2, and consequently an insufficient anti-slipping effect may be exhibited. On the other hand, the upper limit of the average distance between loops is preferably 10 mm, and more preferably 5 mm. When the average distance between loops is greater than the upper limit, the heat-retaining property may be impaired.

Coating Layer

The coating layer 2 is formed by impregnating the glove body 1 with a resin or rubber composition.

The resin or rubber composition (hereinafter, may be also referred to as "compound") contains a resin or rubber as a principal component, a solvent, and other additive(s). Examples of the resin include vinyl chloride, polyurethane, vinylidene chloride, silicones, polyvinyl alcohol, chlorinated polyethylene, ethylene-vinyl alcohol copolymers, a mixture thereof, and the like. Of these, vinyl chloride and polyurethane are preferably used. Moreover, examples of the rubber include natural rubber, isoprene rubber, acrylic rubber, chloroprene rubber, butyl rubber, butadiene rubber, fluorine-containing rubber, styrene-butadiene copolymers, chlorosulfonated polyethylene, epichlorohydrin rubber, urethane rubber, ethylene-propylene rubber, a mixture thereof, and the like. Of these, diene-based rubber such as natural rubber, isoprene rubber, butadiene rubber, styrene butadiene rubber, chloroprene rubber and acrylonitrile-butadiene copolymers is preferably used, and in light of aspects of economy, ease of processing, elasticity, durability, weather resistance, etc., natural rubber and acrylonitrile-butadiene rubber are particularly preferred.

The solvent is exemplified by water, an organic solvent, and the like. In particularly, the solvent is preferably water. In a case where the acrylonitrile-butadiene rubber is contained as the principal component, commercially available latexes such as, e.g., acrylonitrile-butadiene-based latexes ("Nipol Lx-550" or "Nipol Lx-551" manufactured by Nippon ZEON Co., Ltd.) can be suitably used as a mixture of the acrylonitrile-butadiene rubber and water. When such latexes are used, the coating layer 2 can be easily and certainly formed.

As the additive, for example, a crosslinking agent, a vulcanization accelerator, an anti-aging agent, a pigment, a thickening agent and the like may be used ad libitum. These may be used either alone, or in combination of two or more types thereof as needed. In addition, in an attempt to attain breathability and grip, the coating layer 2 may be provided as a foamed coating layer through adding a whipping agent, a foam stabilizer, a foaming agent and/or the like.

The inner surface of the glove body 1 is not impregnated with the coating layer 2. When the inner surface of the glove body 1 is not impregnated with the coating layer 2, the texture of the inner surface of the glove body 1 may be maintained, and consequently a favorable feel of the glove during the use thereof may be attained.

At least a loop portion of the loop yarn projecting from the outer surface of the glove body 1 is impregnated with the coating layer 2. When the loop portion is impregnated with the coating layer 2, the glove exhibits a superior anti-slipping effect while maintaining the heat-retaining property and the bending flexibility.

Glove

According to the glove, the surface of the coating layer has irregularities arising from the loop yarn. The irregularities exert a superior anti-slipping effect.

The lower limit of the ten-point mean roughness (Rz) of the surface of the coating layer is preferably 300 μm, and more preferably 350 m. When the ten-point mean roughness (Rz) is less than the lower limit, sufficient anti-slipping effect may not be exhibited. On the other hand, the upper limit of the ten-point mean roughness (Rz) is preferably 1,200 μm. When the ten-point mean roughness (Rz) is greater than the upper limit, the followability of the glove may be deteriorated and work efficiency may be reduced.

The lower limit of the kinetic coefficient of friction of the glove is preferably 1.35, and more preferably 1.4. When the kinetic coefficient of friction is less than the lower limit, the anti-slipping effect of the glove may be insufficiently attained. The kinetic coefficient of friction as referred to herein means a value obtained by making a measurement on a test piece cut out from the palm region of the glove in accordance with ASTM D1894.

The upper limit of the bending flexibility (B value) of the glove as determined by a pure bending test is preferably 0.85 $gf \cdot cm^2/cm$, and more preferably 0.8 $gf \cdot cm^2/cm$. When the bending flexibility is greater than the upper limit, the flexibility may be inadequate, and consequently the work efficiency may be reduced.

When the coating layer 2 of the glove is abraded during the use thereof, the loop of the loop yarn will be slightly exposed on the surface of the coating layer. Thus, superior moisture permeability will be ensured. Moreover, even when the loop is slightly exposed, the abrasion strength and/or the anti-slipping effect of the overall coating layer 2 are less likely to be deteriorated. Therefore, the moisture permeability, the abrasion strength and the anti-slipping effect of the glove are likely to be maintained without deterioration during the use thereof.

The upper limit of the press bending load at a displacement of 1 mm from the lateral face of the protruding part arising from the loop yarn of the glove is preferably 0.45 N, and more preferably 0.4 N. When the press bending load is greater than the upper limit, the glove may be hardly deformed in accordance with an object to be gripped and have inferior followability, and therefore the anti-slipping effect may not be sufficiently exhibited.

The upper limit of the press bending load of the protruding part arising from the loop yarn of the glove at a displacement of 0.5 mm is preferably 0.25 N, and more preferably 0.2 N. When the press bending load is greater than the upper limit, the glove may be hardly deformed in accordance with an object to be gripped and have inferior followability, and therefore the anti-slipping effect may not be sufficiently exhibited.

Moreover, the lower limit of the moisture permeability of the coating layer 2 of the glove after 500 abrasion cycles as determined using a tester, Nu-Martindale, defined by EN ISO 12947-1, in accordance with the European Standard EN 388; 2003 is preferably 400 $g/m \cdot 24$ h, and more preferably 450 $g/m^2 \cdot 24$ h. When the moisture permeability is less than the lower limit, an unpleasant feeling due to retention of excessive moisture during the wearing of the glove may be enhanced, and consequently the glove may fail to be worn comfortably over a long time period.

Production Method

Next, the production method of the glove having the aforementioned constitution will be briefly explained, but the production method according to the present invention is not anyhow limited to the following.

The production method of the aforementioned glove includes the steps of: forming the glove body 1; immersing the glove body 1 in a coagulating agent; immersing the glove body 1 immersed in the coagulating agent in a compound, followed by hardening by heat to form the coating layer 2; and removing soluble non-rubber component(s) remaining in the coating layer 2 through leaching.

In the step of forming the glove body, a loop yarn is knitted so as to form a glove shape by means of a glove knitting machine, whereby the glove body 1 is formed.

In the step of the immersion in the coagulating agent, the glove body 1 is put on a hand mold, and then a part of a palm portion and/or a fingertip portion, or the entire glove body 1 is/are immersed in the coagulating agent. Examples of the coagulating agent include sodium chloride, calcium chloride, calcium nitrate, acetic acid, citric acid, and the like. These may be used either alone, or in combination of two or more types thereof. Of these, calcium nitrate is preferred in light of attaining a coagulation effect in a shorter time period. In addition, examples of the solvent for the coagulating agent include methanol, water, and the like.

In the step of hardening by heat, after permitting sufficient dripping of the unnecessary coagulating agent, a part of the palm region and/or the fingertip portion, or the entire glove body 1 is/are immersed in the compound, and the compound is hardened by heat to form the coating layer 2.

In the step of leaching, the glove body 1 having the coating layer 2 formed thereon is immersed in hot water for a given time period, whereby the soluble non-rubber component(s) remaining in the coating layer 2 is/are removed.

The leaching may be carried out in any of: a gelatinous state in which the coating layer 2 contains moisture; a semi-crosslinked and semi-vulcanized state which is attained after drying is carried out at a temperature of 60° C. to 95° C. for 3 to 10 min; and a completely vulcanized state which is attained after heating is carried out at a temperature of 120° C. to 140° C. for 20 to 60 min.

The leaching step may be carried out after applying water soluble particle matter, immediately after the immersion of the glove body 1 in the compound. Alternatively, the leaching step may be carried out after drying the glove body 1 immediately after the immersion of the glove body 1 in the compound until the surface of the glove body 1 becomes gelatinous, and thereafter immersing the glove body 1 in a solvent such as toluene, xylene, hexane or methyl ethyl ketone. The immersion of the glove body 1 in the solvent in this manner may allow for a further increase of the irregularities of the surface of the coating layer 2, leading to an enhancement of the anti-slipping effect. Furthermore, the flexibility of the glove may be enhanced, and superior moisture permeability comparable to that after abrasion may be exhibited before abrasion.

Since the glove body 1 of the glove includes the loops of the loop yarn on both sides, and an air layer exists on the glove body 1, a certain time period and heat are necessary to elevate the temperature of the glove to a higher level. The production method described above (coagulation method) is suitable for the production of the glove because of unnecessity of high temperatures.

Advantages

The glove employs the loop yarn as the knitting yarn of the glove body 1. Since according to the loop yarn, the float yarn 32 projects irregularly, and the projecting float yarn 32 provides adequate irregularities on the surface of the coating layer 2, the glove 1 exhibits a superior anti-slipping effect. In addition, the float yarn 32 of the loop yarn is secured to the core yarn 31 by means of the presser yarn 33, and therefore is less likely to fall out. Therefore, the glove is less likely to cause the deterioration of the anti-slipping effect during the use thereof. Moreover, since the loop yarn exhibits a superior heat-retaining effect, even a thinner fabric can exhibit a comparable or more superior heat-retaining property, and accordingly the glove may exhibit an enhanced heat-retaining property without the deterioration of the bending flexibility.

Other Embodiments

The present invention is not limited to the embodiments described above. For example, although the glove body is impregnated with the coating layer in the embodiments described above, the glove body may not be substantially impregnated with the coating layer. Even in the case in which the glove body is not impregnated with the coating layer, the projecting float yarn provides adequate irregularities on the surface of the coating layer, and thus the glove can exert similar effects.

Although in the embodiments described above, the glove including the glove body knitted using the loop yarn alone has been explained, the loop yarn may be used in a part of the glove body, and the remaining part of the glove body may be formed using a well-known knitting yarn other than the loop yarn, e.g., woolly nylon, polyester, or the like. For example, even in the case in which the loop yarn is used in only a part of the glove, for example, a fingertip portion, the anti-slipping effect owing to the loop yarn can be exhibited. Moreover, a part or the entirety of the inner surface or the outer surface of the glove body may be subjected to the nap-raising to enhance the heat-retaining property thereof.

Although in the embodiments described above, the glove has been explained in which the coating layer is overlaid on the palm region and the lateral regions thereof, and the fingertip regions, the region on which the coating layer is overlaid is not limited thereto. For example, full-coating in which the coating is applied from the fingertip portion to a wrist portion on both the palm side and the back side of the hand, or knuckle coating in which the coating is applied except for the side corresponding to the back side of the hand may be carried out. In addition, although the case in which one layer of the coating layer is overlaid has been explained, multilayer coating that involves two or more layers may be carried out.

Although in the embodiments described above, the coagulation method has been explained by way of an example of the production method of the glove, other production method, e.g., a thermal method, may be employed. In the thermal method, a heat-sensitive agent is added to a blend liquid beforehand, and a coating layer is formed through the gelation of the blend liquid by heat.

EXAMPLES

Hereinafter, the invention will be explained in more detail by way of Examples, but the invention is not anyhow limited to the following Examples.

Nine types of glove bodies and three types of compounds each described below were used to produce gloves.

Each glove body used is as shown in Table 1 below. The glove bodies shown below were not subjected to nap-raising.

TABLE 1

| | Knitting machine | Total fineness (dtex) | Knitting yarn | Outer diameter of loops (mm) | Distance between loops (mm) | Details of yarns |
|---|---|---|---|---|---|---|
| A | 13 G | 524 | loop yarn | 3 | 3 | core yarn: 33 dtex-polyurethane elastic fiber covered with single 78 dtex-24F woolly nylon; float yarn: acrylic spun 1/28; and presser yarn: single 56 dtex-17F woolly nylon |
| B | 13 G | 500 | loop yarn | 3 | 3 | core yarn: 33 dtex-polyurethane elastic fiber covered with single 78 dtex-24F woolly nylon; float yarn: double woolly nylon 166 dtex-48F; and presser yarn: single 56 dtex-17F woolly nylon |
| C | 13 G | 556 | loop yarn | 3 | 3 | core yarn: 33 dtex-polyurethane elastic fiber covered with single 58 dtex-17F woolly nylon; float yarn: acrylic spun 1/28; and presser yarn: single 111 dtex-24F woolly nylon |
| D | 10 G | 902 | loop yarn | 3 | 3 | core yarn: 33 dtex-polyurethane elastic fiber covered with single 78 dtex-24F woolly nylon float yarn: acrylic spun 2/28; and presser yarn: single 78 dtex-24F woolly nylon |
| E | 10 G | 958 | loop yarn | 3 | 3 | core yarn: yarn provided by using 78 dtex-24F woolly nylon and 56 dtex-17F woolly nylon; float yarn: acrylic spun 2/28; and presser yarn: single 111 dtex-24F woolly nylon |
| F | 10 G | 935 | loop yarn | 3 | 3 | core yarn: 78 dtex-polyurethane elastic fiber covered with single 444 dtex-390F HPPE; float yarn: single acrylic spun 1/28; and presser yarn: single 56D-17F woolly nylon |
| G | 10 G | 794 | composite | — | — | outer side: PE spun #20/1; and inner side: acrylic spun 2/40 (pile fabric) |
| H | 10 G | 908 | composite | — | — | outer side: PE spun #30/1 and COT#30/1; and inner side: acrylic spun 2/40 (pile fabric) |
| I | 10 G | 1027 | composite | — | — | outer side: PE spun #30/1 and COT#30/1; and inner side: acrylic spun 1/28 and acrylic span 1/36 (pile fabric) |

The formulation of each compound used is as shown in Table 2 below.

TABLE 2

| Compounding agent | Manufacturer | Amount (parts by weight) blend 1 | blend 2 | blend 3 |
|---|---|---|---|---|
| NBR latex | Nippon ZEON Co., Ltd. | 100 | — | 100 |
| NR latex | Sunwise Pearl SDN BHD | — | 100 | — |
| sulfur | Kanto Chemical Co., Inc. | 2.0 | 1.0 | 2.0 |
| zinc ozide | Kanto Chemical Co., Inc. | 1.0 | 0.5 | 1.0 |

TABLE 2-continued

| Compounding agent | Manufacturer | Amount (parts by weight) blend 1 | blend 2 | blend 3 |
|---|---|---|---|---|
| vulcanization accelerator (zinc dibutyldithio-carbamate) | Ouchi Shinko Chemical Industrial Co., Ltd | 0.5 | 0.2 | 0.5 |
| anti-aging agent (2,2'methy-lenebis(4-ethyl-6-tert-butylphenol)) | LANXESS | 0.5 | 0.5 | 0.5 |
| heat-sensitive agent (aqueous solution of polyether-modified silicone) | Momentive Performance Materials Inc. | 0.15 | 0.15 | 0.15 |

TABLE 2-continued

| Compounding agent | Manufacturer | Amount (parts by weight) blend 1 | blend 2 | blend 3 |
|---|---|---|---|---|
| NBR particle (mesh opening size; 710 μm; 90% Pass) | Toakaseinin Corporation | — | — | 40 |

* Shown in terms of solid content equivalent.

Test production methods for preparing the gloves were as described below, unless otherwise specified particularly. First, each glove body was put on a hand mold, then conditioned in a temperature-controlled oven such that the temperature of the surface thereof reached 60° C., and immersed in a coagulating agent containing 1 part by mass of calcium nitrate with respect to 100 parts by mass of methanol. The glove body taken out of the coagulating agent was left to stand for 30 sec so as to permit dripping of the unnecessary coagulating agent, followed by drying for 30 sec, and then only the palm region of the glove body was immersed in the compound. Thereafter, drying was carried out at 90° C. for 10 min, and then the glove body was removed from the hand mold, followed by leaching at 30° C. for 30 min. Furthermore, the glove body was dehydrated for 1 min and then put on a hand mold, followed by subjecting to curing at 130° C. for 40 min. Thus, the glove was formed.

Examples 1 to 6

In Examples 1 to 6, test production was made using the compound of the blend 1 for each of the glove bodies A, B, C, D, E and F under the aforementioned test production condition.

Examples 7 to 12

In Examples 7 to 12, test production was made using the compound of the blend 2 for each of the glove bodies A, B, C, D, E and F under the aforementioned test production condition.

Examples 13 to 18

In Examples 13 to 18, test production was made using the compound of the blend 2 for each of the glove bodies A, B, C, D, E and F by following the procedure according to the aforementioned test production condition up to the step of immersing only the palm region of the glove body in the compound, then drying the surface thereof at 110° C. for 10 sec, immediately followed by immersion of the glove body in 100 parts by mass of a xylene solvent for 5 sec, then drying the glove body at 90° C. for 10 min, followed by removing from the hand mold, and then carrying out leaching at 30° C. for 30 min, dehydration for 1 min, and curing at 130° C. for 40 min.

Comparative Examples 1 to 3

In Comparative Examples 1 to 3, test production was made using the compound of the blend 1 for each of the glove bodies G, H and I under the aforementioned test production condition.

Comparative Examples 4 to 6

In Comparative Examples 4 to 6, test production was made using the compound of the blend 2 for each of the glove bodies G, H and I under the aforementioned test production condition.

Comparative Examples 7 to 9

In Comparative Examples 7 to 9, test production was made using the compound of the blend 2 for each of the glove bodies G, H and I under the aforementioned test production condition, with the glove bodies being turned inside out such that the coating layer was overlaid on the pile fabric.

Comparative Example 10

In Comparative Example 10, test production was made using the compound of the blend 1 for the glove body G by following the procedure according to the aforementioned test production condition up to the step of immersing only the palm region of the glove body in the compound, then drying at 75° C. for 10 min, immersing only the palm region in the compound of the blend 3, followed by removing from the hand mold, and then carrying out leaching at 30° C. for 30 min, dehydration for 1 min, and curing at 130° C. for 40 min.

Values of the following characteristics were determined for Examples 1 to 18 and Comparative Examples 1 to 10.

The kinetic coefficient of friction was measured using a test piece cut out from the palm region of the glove and having a size of 63.5 mm×83.5 mm. The measurement method was in accordance with ASTM D1894. Specifically, the test piece was attached to a movable weight (friction surface: 63.5 mm×63.5 mm) of an apparatus for determining the frictional coefficient, then the movable weight was allowed to run just a travel distance of 130 mm at 150 mm/min on a stainless steel plate, and the friction force in this operation was measured. The kinetic coefficient of friction was calculated by dividing an average friction force after attaining regular running by the normal reaction of the movable weight.

The heat-retaining property was determined according to the following procedure. A hand mold made from a metal was warmed at 60° C. for 1 hour in a temperature-controlled oven (Perfect Oven "PV-211" manufactured by ESPEC Corporation). Next, the hand mold made from the metal was taken out, then a test glove for determination was quickly put thereon, and after 5 min, the glove was removed from the hand mold. The temperature of the central portion of the palm region immediately after the removal was measured using an infrared thermograph ("Handy Thermo TVS-200" manufactured by Nippon Avionics Co., Ltd.).

The bending flexibility was determined based on the B value obtained from the pure bending test. Specifically, a test piece having a size of 20 mm×50 mm was cut out from a finger portion of a glove, and a measurement was conducted thereon using a pure bending tester ("KES-FB2" manufactured by Kato tech Co., Ltd.). The measurement conditions involved SENS of 20 and a curvature of 2.5 $cm^{-1}$, and the measurement was conducted three times with the test piece being bent along the same direction as a possible bending direction of the finger portion.

The moisture permeability was measured in accordance with JIS L 1099A-1 (calcium chloride method).

The abrasion loss was determined using a tester, Nu-Martindale, defined by EN ISO 12947-1, in accordance with the European Standard EN 388; 2003.

The press bending load was measured on the gloves from Example 9, Example 15, Comparative Example 4 and Comparative Example 10, using a test piece cut out from the palm region of the glove and having a size of 20 mm×40 mm. In the measurement method, a protruding part of the test piece was bent by pressing from a lateral face, and the loads applied when the displacements of 0.5 mm and 1 mm, respectively were attained were measured. The measurement was conducted using a force displacement measurement unit ("FSA-0.5K2-2N" manufactured by Imada Co., Ltd.).

The results of the evaluations are shown in Tables 3 and 4.

TABLE 4

| | Press bending load (N) | |
|---|---|---|
| | at displacement of 0.5 mm | at displacement of 1 mm |
| Example 9 | 0.15 | 0.35 |
| Example 15 | 0.11 | 0.27 |

TABLE 4-continued

| | Press bending load (N) | |
|---|---|---|
| | at displacement of 0.5 mm | at displacement of 1 mm |
| Comparative Example 4 | 0.28 | 0.47 |
| Comparative Example 10 | 0.61 | 0.72 |

In regard to the kinetic coefficient of friction, a greater value indicates a superior anti-slipping effect. The gloves according to Examples that include the loop yarn gave greater values than the gloves according to Comparative Examples, which have a coating layer containing conventional anti-slipping particles or a coating layer including a reversed pile fabric, indicating a more superior anti-slipping effect.

In regard to the heat-retaining property, a higher temperature after 5 min indicates a superior heat-retaining property. For example, when Example 1 is compared with Comparative Example 3, it is found that even the glove having a total fineness of 501 dtex exhibited a heat-retaining property either equaling or surpassing that of the glove having a total

TABLE 3

| | Blend | Glove body | Total fineness (dtex) | Projection on coating layer surface | Bending flexibility (gf · cm²/cm) | Kinetic coefficient of friction | Abrasion loss (mg) after 500 abrasion cycles | Abrasion loss (mg) after 1,000 abrasion cycles | Heat-retaining property at 60° C. after 5 min (° C.) | Moisture permeability (g/m² · 24 h) before abrasion | Moisture permeability (g/m² · 24 h) after 500 abrasion cycle |
|---|---|---|---|---|---|---|---|---|---|---|---|
| Example 1 | blend 1 | A | 524 | yes | 0.72 | 1.48 | 12.5 | 16.1 | 45.1 | 157 | 430 |
| Example 2 | (NBR) | B | 500 | yes | 0.70 | 1.40 | 12.5 | 16.0 | 45.0 | 158 | 440 |
| Example 3 | | C | 556 | yes | 0.75 | 1.50 | 13.0 | 16.7 | 45.6 | 155 | 447 |
| Example 4 | | D | 902 | yes | 0.80 | 1.45 | 13.3 | 16.3 | 46.1 | 147 | 470 |
| Example 5 | | E | 958 | yes | 0.83 | 1.43 | 13.1 | 16.8 | 46.2 | 160 | 451 |
| Example 6 | | F | 935 | yes | 0.82 | 1.44 | 13.3 | 16.5 | 45.1 | 158 | 460 |
| Example 7 | blend 2 | A | 524 | yes | 0.61 | 1.75 | 15.0 | 22.0 | 45.2 | 142 | 450 |
| Example 8 | (NR) | B | 500 | yes | 0.59 | 1.67 | 14.9 | 22.2 | 45.2 | 140 | 460 |
| Example 9 | | C | 556 | yes | 0.63 | 1.73 | 15.4 | 22.1 | 45.5 | 180 | 475 |
| Example 10 | | D | 902 | yes | 0.68 | 1.74 | 14.1 | 21.8 | 46.3 | 170 | 461 |
| Example 11 | | E | 958 | yes | 0.73 | 1.78 | 14.7 | 22.5 | 46.6 | 162 | 515 |
| Example 12 | | F | 935 | yes | 0.70 | 1.75 | 14.5 | 22.0 | 45.4 | 165 | 470 |
| Example 13 | blend 2 | A | 524 | yes | 0.40 | 1.90 | 14.4 | 20.1 | 45.7 | 410 | 451 |
| Example 14 | (NR) | B | 500 | yes | 0.37 | 1.79 | 14.3 | 20.5 | 45.5 | 420 | 455 |
| Example 15 | solvent | C | 556 | yes | 0.43 | 1.85 | 14.8 | 21.2 | 45.8 | 480 | 475 |
| Example 16 | patterned | D | 902 | yes | 0.55 | 1.83 | 15.1 | 21.8 | 46.0 | 447 | 501 |
| Example 17 | | E | 958 | yes | 0.58 | 1.84 | 15.5 | 22.5 | 46.8 | 485 | 585 |
| Example 18 | | F | 935 | yes | 0.56 | 1.83 | 15.3 | 22.2 | 45.5 | 470 | 480 |
| Comparative Example 1 | blend 1 (NBR) | G | 794 | no | 0.90 | 1.10 | 13.1 | 15.7 | 44.0 | 150 | 184 |
| Comparative Example 2 | | H | 908 | no | 0.93 | 1.11 | 13.7 | 16.0 | 44.5 | 155 | 170 |
| Comparative Example 3 | | I | 1027 | no | 1.08 | 1.05 | 14.0 | 15.8 | 44.7 | 145 | 143 |
| Comparative Example 4 | blend 2 (NR) | G | 794 | no | 0.86 | 1.20 | 14.5 | 19.7 | 44.1 | 157 | 155 |
| Comparative Example 5 | | H | 908 | no | 0.88 | 1.21 | 14.1 | 21.5 | 44.7 | 180 | 175 |
| Comparative Example 6 | | I | 1027 | no | 0.98 | 1.18 | 15.0 | 22.0 | 44.8 | 170 | 168 |
| Comparative Example 7 | blend 2 (NR) | G | 794 | substantially no | 1.62 | 1.13 | 14.7 | 21.5 | 43.7 | 133 | 284 |
| Comparative Example 8 | inside out | H | 908 | substantially no | 1.67 | 1.14 | 14.8 | 21.8 | 43.9 | 141 | 285 |
| Comparative Example 9 | | I | 1027 | substantially no | 1.71 | 1.16 | 15.0 | 22.1 | 44.2 | 144 | 286 |
| Comparative Example 10 | blends 1 and 3 | G | 794 | yes | 0.93 | 1.12 | 67.0 | 106.0 | 44.0 | 130 | 135 |

fineness of 1,027 dtex. Since a smaller total fineness gives a smaller thickness, it is found that the glove from Example 1 exhibits a superior heat-retaining property in spite of the smaller thickness of the fabric.

In regard to the bending flexibility, a smaller value indicates greater flexibility. In comparison of Examples with Comparative Examples, it is seen that values from Examples are smaller and therefore the gloves employing the loop yarn are more flexible.

In regard to the moisture permeability, a greater value indicates a greater reduction effect on an unpleasant feeling due to retention of excessive moisture. In comparison of Examples with Comparative Examples, Examples show superior moisture permeability after 500 abrasion cycles. The values from Examples are greater than those from Comparative Examples 7 to 9 in which the outer surface is constituted with a pile fabric. It is found that the gloves employing the loop yarn exhibit more superior moisture permeability after the abrasion.

In regard to the abrasion loss, a greater value indicates lower abrasion resistant strength and easier abrasion. In comparison of Examples with Comparative Examples, it is seen that the abrasion loss is comparable among Examples and Comparative Examples employing the same compounding agent and glove body, and a decrease of the abrasion strength does not occur in Examples.

In regard to the press bending load, a smaller value indicates greater easiness to be deformed in accordance with an object to be gripped and superior followability. In comparison of Examples with Comparative Examples, it is seen that the values from Examples are smaller and the gloves employing the loop yarn exhibit more superior followability.

INDUSTRIAL APPLICABILITY

As set forth in the foregoing, the glove employing the loop yarn according to the embodiment of the present invention exhibits a superior anti-slipping effect, and achieves a superior heat-retaining property while achieving superior bending flexibility. Accordingly, even in the use of the glove for a long time period, the retention of excessive moisture inside the glove is unlikely to occur, and achieves favorable workability and wearability. Therefore, the glove can be suitably used, for example, in packing works, carrying works and the like at factories, etc.

EXPLANATION OF THE REFERENCE SYMBOLS

1 glove body
2 coating layer
31 core yarn
32 float yarn
33 presser yarn

The invention claimed is:

1. A glove comprising:

a glove body made of fibers, the glove body being for covering a hand of a wearer; and a coating layer made of a resin or rubber, the coating layer being overlaid at least on a palm region of an outer surface of the glove body, wherein: a loop yarn, usable as a knitting yarn of the glove body, comprises a core yarn, a float yarn and a presser yarn, wherein the float yarn is arranged around the core yarn so as to form projecting loop portions of loops of the loop yarn, and the presser yarn secures the float yarn to the core yarn by covering a portion of the float yarn, and wherein the loop portions are not covered by the presser yarn, are spaced apart from the core yarn, and project away from the presser yarn and the core yarn;

an average outer diameter of the loops of the loop yarn is no less than 1 mm and no greater than 6 mm, wherein the average outer diameter of the loops of the loop yarn is defined as an average of a diameter of a perfect circle having an area equal to an area surrounded by a center line of the float yarn and a center line of the core yarn loop portions;

irregularities arising from the float yarn of the loop yarn are provided on a surface of the coating layer; and a total fineness of the loop yarn is no less than 100 dtex and no greater than 1,000 dtex.

2. The glove according to claim 1, wherein a ten-point mean roughness (Rz) of the surface of the coating layer is no less than 300 μm and no greater than 1,200 μm.

* * * * *